US011444373B1

(12) United States Patent
Rivera

(10) Patent No.: US 11,444,373 B1
(45) Date of Patent: Sep. 13, 2022

(54) BUOY ANTENNA

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/471,318

(22) Filed: Sep. 10, 2021

(51) Int. Cl.
*H01Q 1/34* (2006.01)
*H01Q 9/28* (2006.01)

(52) U.S. Cl.
CPC ..... *H01Q 1/34* (2013.01); *H01Q 9/28* (2013.01)

(58) Field of Classification Search
CPC ..... H01Q 1/34; H01Q 9/28; H01Q 13/04
See application file for complete search history.

(56) References Cited

U.S. PATENT DOCUMENTS 3,656,166 A * 4/1972 Klopach ..... H01Q 15/244 343/773
4,635,068 A * 1/1987 Wheeler ..... H01Q 9/28 343/749
D311,540 S * 10/1990 Wickrema ..... D14/236
6,667,721 B1 * 12/2003 Simonds ..... H01Q 9/28 343/773
7,123,205 B2 * 10/2006 Ratajczak ..... H01Q 9/28 343/773
9,077,080 B1 * 7/2015 Josypenko ..... H01Q 9/28
9,356,354 B2 * 5/2016 Yona ..... H01Q 9/40
2007/0205961 A1 * 9/2007 Black ..... H01Q 19/062 343/909
2020/0036075 A1 * 1/2020 Ding ..... H01Q 1/1221
2020/0052409 A1 * 2/2020 Scannell ..... H01Q 13/04
2020/0161741 A1 * 5/2020 Hiramatsu ..... B32B 17/1022

* cited by examiner

*Primary Examiner* — Ab Salam Alkassim, Jr.
(74) *Attorney, Agent, or Firm* — James M. Kasischke; Michael P. Stanley

(57) ABSTRACT

A buoy antenna assembly with a hub having a first conical cavity in a top portion and a second conical cavity in a bottom portion is provided. The first conical cavity aligns with the second conical cavity with a space between an apex of the first conical cavity and an apex of the second conical cavity. Each of the first conical cavity and the second conical cavity is plated with a conducting material. A plurality of vanes attaches at an angle to the hub. A transmission line attaches to plated portions of the first conical cavity and the second conical cavity. The dimensions of buoy antenna assembly are determined by selecting a center design frequency followed by a calculation of the corresponding wavelength in the material of the hub and the vanes.

12 Claims, 7 Drawing Sheets

BUOY ANTENNA

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

CROSS REFERENCE TO OTHER PATENTS APPLICATIONS

None.

BACKGROUND OF THE INVENTION

(1) Field of the Invention

The present invention is directed to an antenna for ocean buoys and more particularly to an antenna able to intercept incoming signals having an arbitrarily-oriented electric field vector.

(2) Description of the Related Art

An antenna can be used for transmission of a signal, in which radio-frequency electrical energy from a transmitter converts to electromagnetic energy and radiates into the surrounding environment for reception of a signal. Electromagnetic energy impinging on the antenna converts into radio-frequency electrical energy and is fed to a receiver. The frequency bandwidth depends on the size and design for a particular frequency while reception and transmission signal strength depends on the orientation of the antenna with respect to a signal path.

Ocean buoys for collecting and processing ambient radio frequency (RF) emissions use omnidirectional antennas that are capable of receiving signals with random electromagnetic polarization. Use of these antennas is advantageous because the antennas are less sensitive to fading and multipath effects due the scattering of signals by ocean waves, as well as changes in water-line height as the buoy device floats on the sea surface.

Ocean buoy antennas are generally expensive, making the total per-unit cost of the buoy assembly (antenna, associated electronics and signal-processing software/firmware) very high; thereby, limiting production. Because of their high cost, the use of ocean buoy antennas is restricted. In order to improve situational awareness beyond restricted regions of use; it is desirable for ocean buoy antennas to have their per-unit cost considerably reduced.

SUMMARY OF THE INVENTION

It is therefore a primary object and general purpose of the present invention to provide an antenna for ocean buoys to intercept incoming signals having an arbitrarily oriented electric field vectors due to scattering by time-varying waves or surface features of the ocean.

It is a further object of the present invention to provide a buoy antenna to receive signals whose electric field is arbitrarily oriented relative to a longitudinal axis of the antenna.

The buoy antenna of the present invention includes a shell that is made from soda-lime-silica glass and has six rectangular vanes with a semicircular cutout. Each vane is tilted and connects to a cylindrical hub. The cylindrical hub section has two conical cavities that are plated with conducting material to form a bi-conical dipole antenna. A transmission line attaches to plated portions of the antenna.

The antenna dimensions are determined by selecting a center design frequency that can be used to calculate a corresponding wavelength in the glass material.

The buoy antenna according to the present invention is very inexpensive to make and provides repeatable unit-to-unit performance due to manufacturing techniques used (i.e., molding).

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

When an antenna is in close proximity to or embedded within a dielectric body of finite dimensions, a standing wave pattern is established within the body that depends on physical shape, material properties, and size relative to the wavelength of operation. The internal standing wave pattern (or modal pattern) influences the resultant external radiation field properties (to transmit or receive) in either a desired or an undesirable way.

According to the present invention, the antenna body shape is capable of omnidirectional reception of signals having random polarization that is facilitated by an internal standing wave pattern characteristic.

Figure 1:
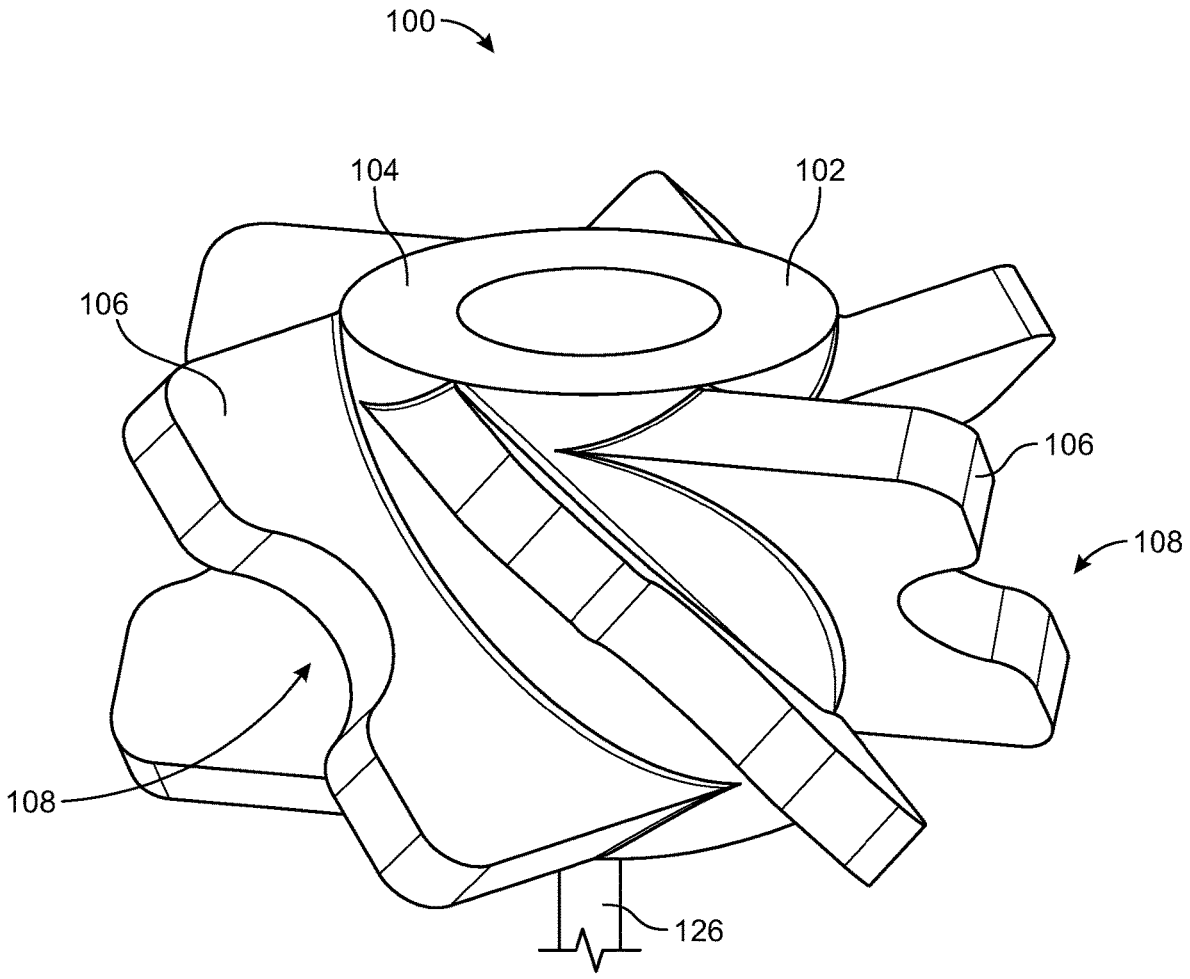
FIG. 1 shows a perspective view of an antenna assembly of the present invention.

FIG. 1 is a perspective view of an antenna assembly 100 of the present invention. The antenna assembly 100 has a shell 102 made from soda-lime-silica glass. The shell 102 includes a body 104 and a plurality of vanes 106 connected to the body. The body 104 can be a solid cylinder, referred herein as a cylindrical hub.

The shell consists of six vanes 106 with each vane having a substantially rectangular shape with a semicircular cutout 108 in each vane. Each vane 106 is tilted with respect to a longitudinal axis of the body 104 in order to form a rosette pattern.

Figure 2:
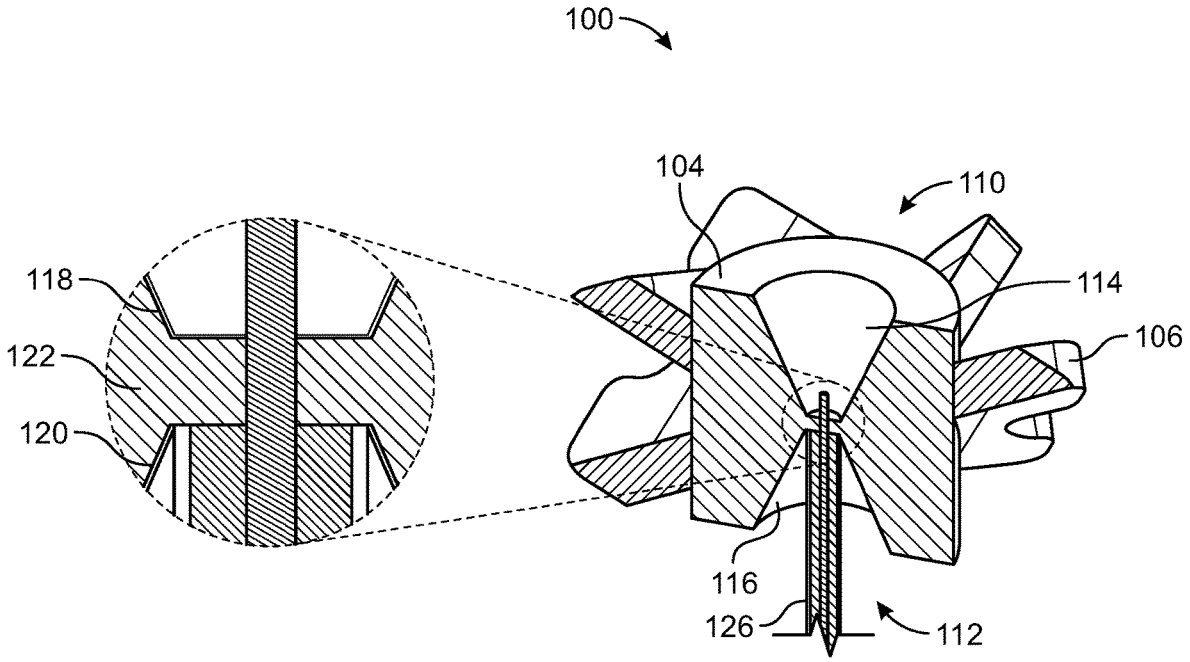
FIG. 2 is a first cross-section view of the antenna assembly of the present invention.
Figure 3:
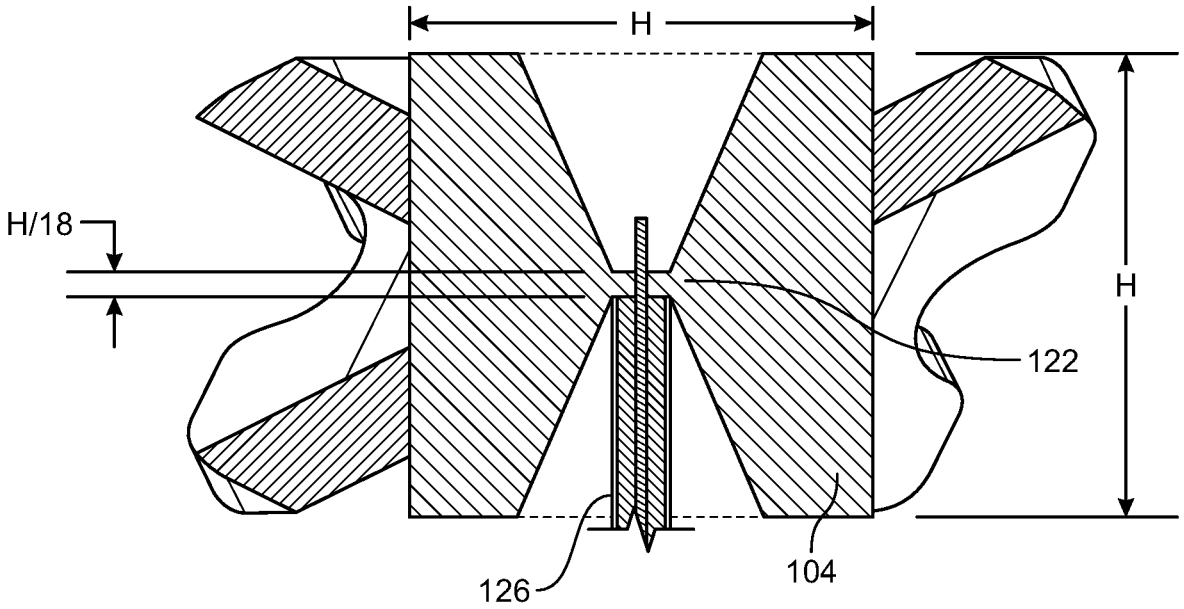
FIG. 3 is a second cross-section view of the antenna assembly with dimensions shown.

Referring to FIG. 2, the body 104 has a top portion 110 and a bottom portion 112. A first conical cavity 114 is located in the top portion 110 and a second conical cavity 116 is located in the bottom portion 112. The first conical cavity 114 is symmetrical with a second conical cavity 116 and aligns along the longitudinal axis of the body 104.

The first conical cavity 114 has a truncated apex 118 and the second conical cavity 116 has a truncated apex 120 with a space 122 between. The first conical cavity 114 and the second conical cavity 116 are plated with a conducting material to form the antenna assembly 100. In this case, the antenna assembly 100 is a bi-conical dipole type antenna.

A transmission line 126 is attached to plated portions of the first conical cavity 114 and the second conical cavity 116. The transmission line 126 can be a coaxial transmission line feed. In some embodiments, the transmission line 126 can be semi-rigid and soldered to the plated portions of the first conical cavity 114 and the second conical cavity 116.

Referring to FIG. 3, FIG. 4, FIG. 5, and FIG. 6; the physical dimensions of the antenna assembly 100 are determined at a desired center design frequency $f_o$ (in Hertz, Hz), followed by a calculation of the corresponding wavelength in the glass material $\lambda_g$ with the use of Equation (1):

$$\lambda_g = \frac{\upsilon_o}{f_o\sqrt{\varepsilon'}} \tag{1}$$

where $\upsilon_o$ is the speed of light ($\approx 3\times10^8$ meters/sec); and $\varepsilon'$ is the relative dielectric constant of the glass material.

Once the wavelength $\lambda_g$ is calculated, dimensions for the various sections of the antenna assembly 100 are determined as multiples of the antenna height dimension H. H was experimentally determined to have a value of $H\approx 2.8\,\lambda_g$. That is, the body 104 has a height H and a diameter H.

Figure 4:
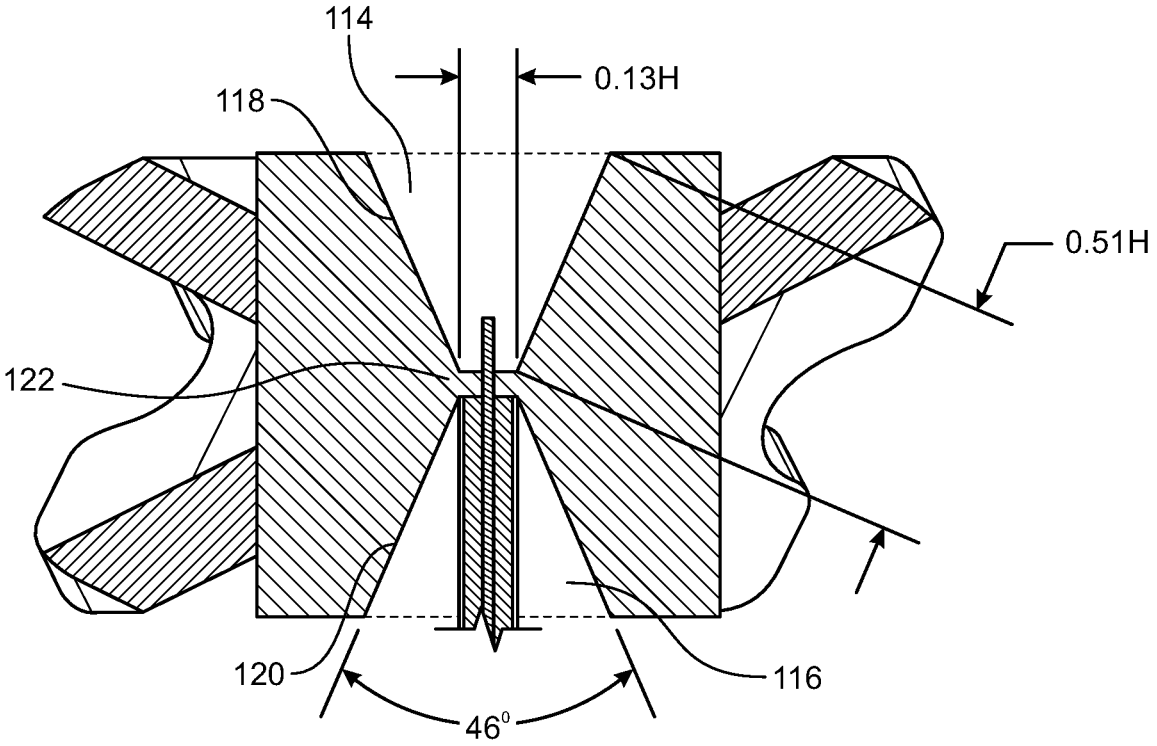
FIG. 4 is a third cross-section view of the antenna assembly with dimensions shown.

As shown in FIG. 4, the first conical cavity 114 has a sidewall length approximately 0.51 H at approximately 23° from vertical. The second conical cavity 116 has a sidewall length approximately 0.51 H at approximately 23° from vertical. In other words, each of the first conical cavity 114 and the second conical cavity 116 defines a cone of approximately 46° in which the truncated apex 118 and the truncated apex 120 have a diameter of approximately 0.13 H. The space 122 between the truncated apex 118 and the truncated apex 120 is approximately H/18.

Figure 5:
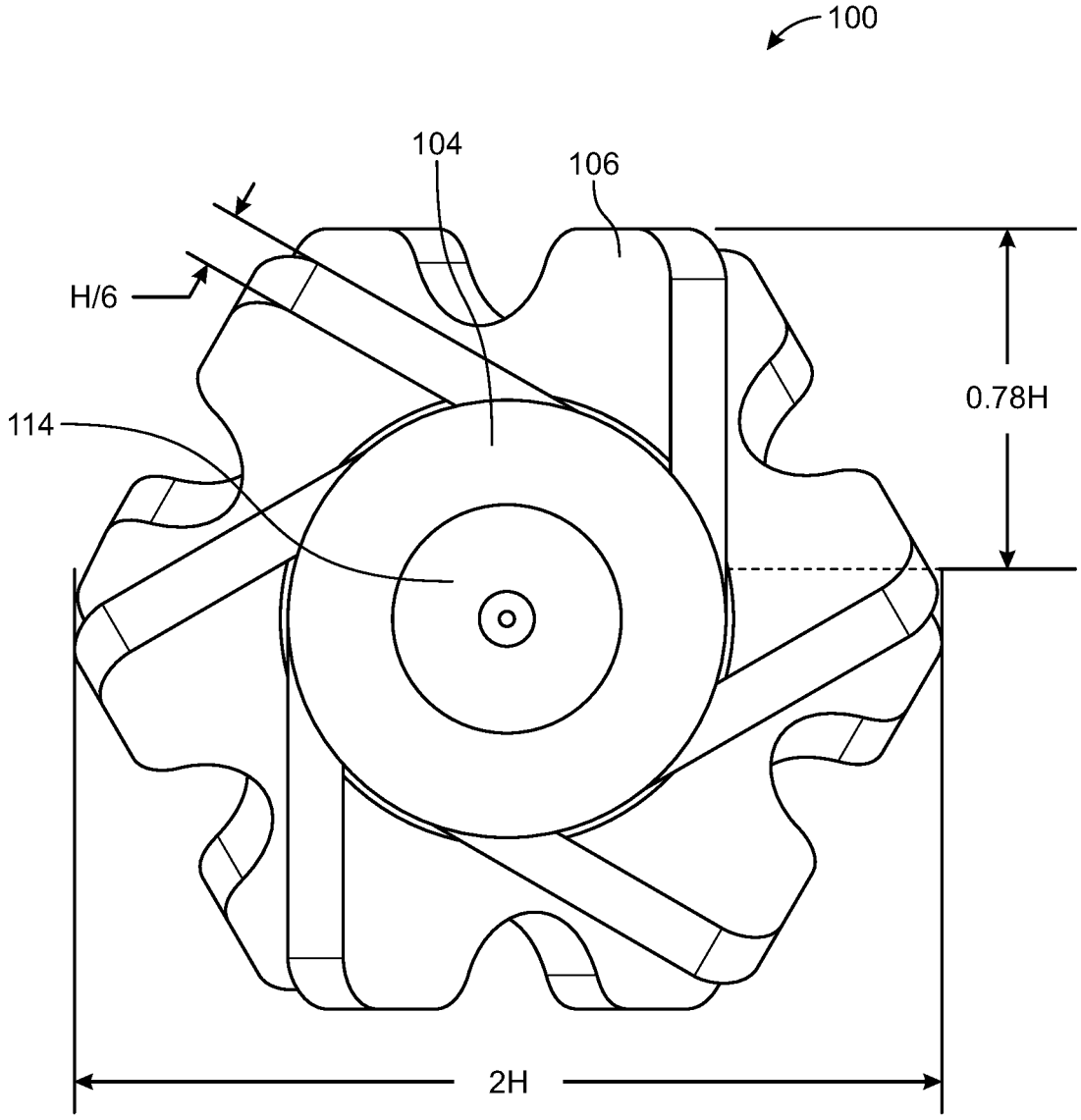
FIG. 5 is a is a top view of the antenna assembly with dimensions shown.
Figure 6:
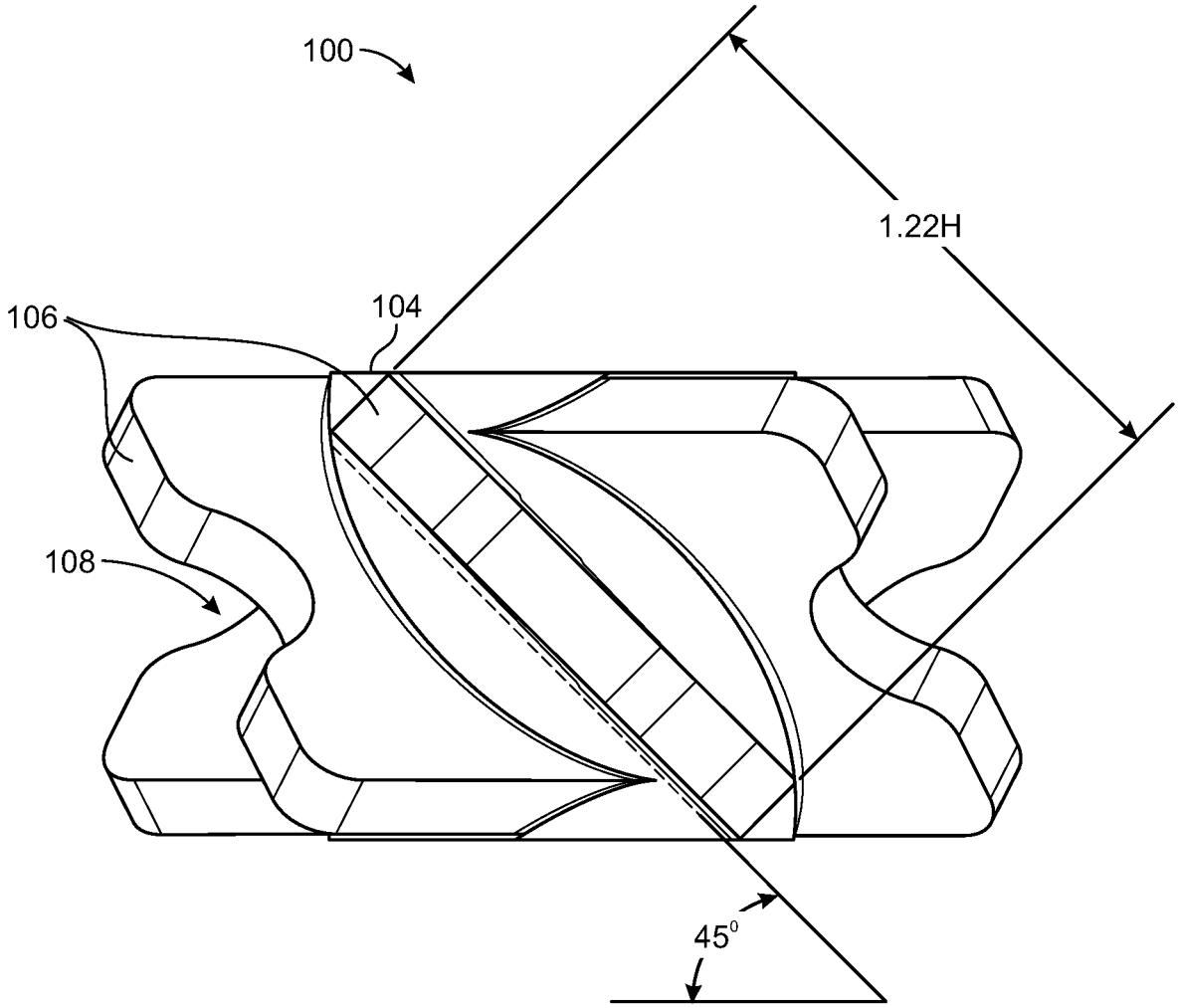
FIG. 6 is a is a side view of the antenna assembly with dimensions shown.

FIG. 5 and FIG. 6 show the dimensions of the vanes 106. Each vane 106 is attached at a 45° angle to the body 104. Each vane 106 has a thickness of approximately H/6, a width of approximately 0.78 H, and a length of approximately 1.22 H. The semicircular cutouts 108 have a radius of approximately 0.22 H. The overall diameter of the antenna assembly 100 is approximately 2H.

The antenna assembly 100 is scalable to a desired center design frequency according to the relative dielectric constant ($\varepsilon'$) of the glass. The soda-lime-silica glass material is selected through a comparison of various dielectrics and per unit volume prices. Using open-literature sources, the prices and dielectric properties of various insulating materials were plotted to find a material with the largest (relative) dielectric constant and the lowest (per unit volume) price. Large deviations in price exist within three classes of insulating materials (plastics, glasses, and ceramics). Container glass (i.e., soda-lime-silica) has the largest dielectric constant ($\varepsilon'\approx 7.5$ at 10 kHz) and the lowest per unit volume cost. A plot of the complex (relative) dielectric permittivity of soda-lime-silica glass is shown FIG. 7. In the plot, the permittivity ($\varepsilon_r$) is defined in Equation (2) as $$\varepsilon_r = \varepsilon' - j\varepsilon'' \tag{2}$$

where $\varepsilon'$ is the dielectric constant, $\varepsilon''$ is the loss factor, and the complex number $j=\sqrt{-1}$.

Figure 7:
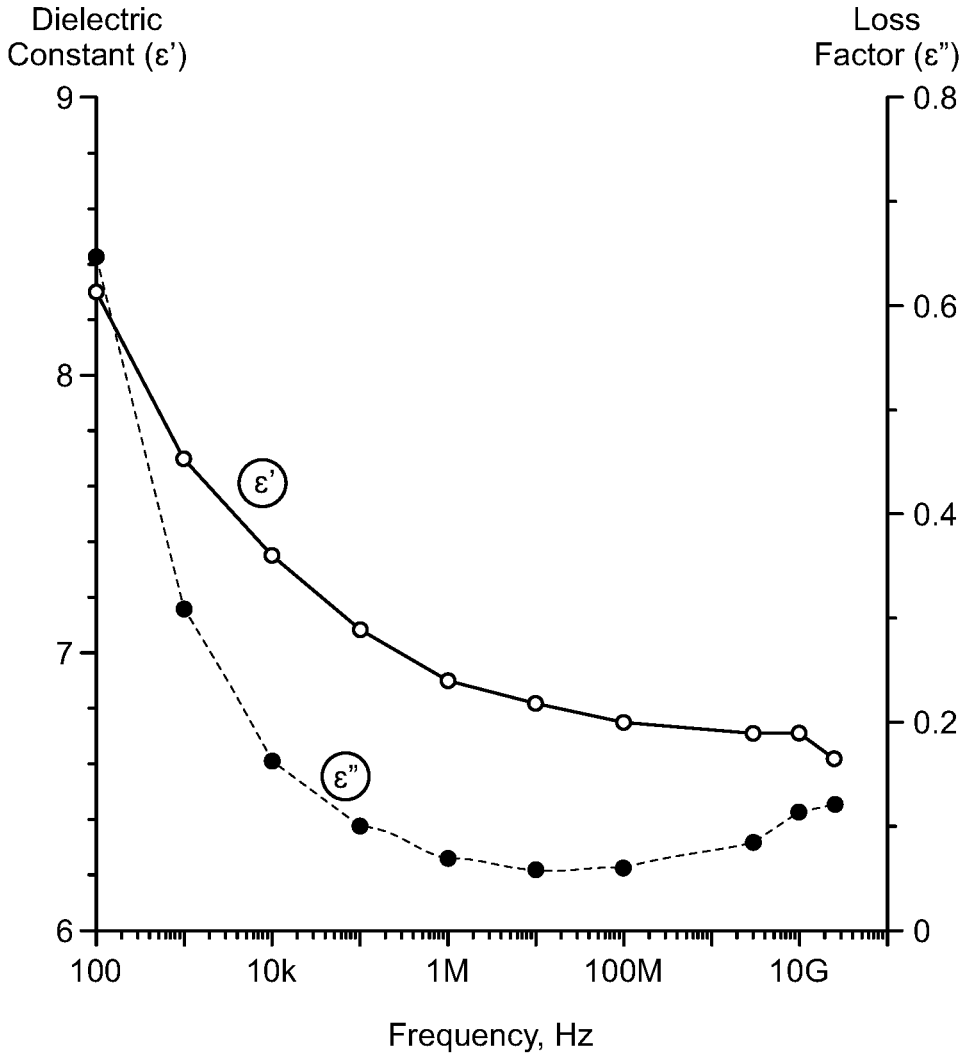
FIG. 7 is a graph of the relative dielectric permittivity ($\varepsilon_r$) of soda-lime-silica glass.

The graph of FIG. 7 shows values of $\varepsilon'$ at different frequencies.

A fundamental characteristic of a dipole antenna not embedded in the glass shape is an ability to discriminate an electric field orientation of a signal. When the arriving electric field orientation is perpendicular to the longitudinal axis; reception is very weak. When the electric field is parallel to the longitudinal axis, reception is maximized. The change in signal reception with electric field orientation is substantial, with the perpendicular field pickup being 30 dB or more below that of the parallel field.

When the dipole is in contact with the glass shape (by a plating process), the antenna assembly 100 is sensitive to electric fields that are either parallel or perpendicular to the longitudinal axis. The antenna assembly 100 can receive both orientations somewhat equally at 0° elevation (the horizon) with a variation at other angles. The glass shape permits the antenna assembly 100 to sense other field orientations, where the corresponding beam patterns are bounded between those that are parallel and perpendicular to the longitudinal axis.

The bandwidth or deviation from the center design frequency ($f_o$) where the antenna assembly 100 is able to effectively sense the parallel, perpendicular, and intermediate electric field orientations is experimentally determined to be by Equation (3)

$$(5/6)f_o \le f \le (6/5)f_o \tag{3}$$

which translates to approximately twenty percent below and 20% above the design center frequency, the total bandwidth being the sum, or 37%, which is considered broad.

The pattern of the antenna 100 over seawater is able to intercept incoming signals having an arbitrarily-oriented electric field vector due to scattering by the ocean time-varying waves or surface features. That is, the antenna assembly 100 is able to receive signals whose electric field is arbitrarily-oriented relative to the longitudinal axis of the antenna assembly.

A buoy antenna according to the present invention is comparatively very inexpensive to make and provides repeatable unit-to-unit performance due to manufacturing techniques used (i.e., molding).

The invention has been described with references to specific embodiments. While particular values, relationships, materials, and steps have been set forth for purposes of describing concepts of the present disclosure, it will be appreciated by persons skilled in the art that numerous variations and/or modifications may be made to the invention as shown in the disclosed embodiments without departing from the spirit or scope of the basic concepts and operating principles of the invention as broadly described.

What is claimed is:

1. An antenna for providing reception at a desired frequency, $f_o$, dimensioned according to an associated wavelength, $\lambda_g$, comprising:

a cylindrical hub having a solid body with a top and a bottom, a vertical height H of said cylindrical hub being equal to approximately 2.8 $\lambda_g$ and a diameter of said cylindrical hub being approximately H;

a first conical cavity in the top of said cylindrical hub, said first conical cavity having a sidewall length approximately 0.51 H at approximately 46° from a vertical axis of said cylindrical hub;

a second conical cavity in the bottom of said cylindrical hub, said second conical cavity having a sidewall length approximately 0.51 H at approximately 46° from the vertical axis of said cylindrical hub;

wherein each of said first conical cavity and said second conical cavity has a truncated apex having a diameter of approximately 0.13 H and a portion of said solid body between said first conical cavity and said second conical cavity having a thickness of approximately H/18; and wherein each of said first conical cavity and said second conical cavity are plated with a conducting material;

a plurality of vanes attached at an angle to an external wall of said cylindrical hub, each vane of said plurality of vanes having a thickness of approximately H/6, a width of approximately 0.78 H, and a length of approximately 1.22 H; and a transmission line attached to plated portions of said first conical cavity and said second conical cavity.

2. The antenna in accordance with claim 1, wherein a material of said cylindrical hub and said plurality of vanes is a soda-lime-silica glass.

3. The antenna in accordance with claim 2, wherein $\lambda_g$ is a wavelength in the soda-lime-silica glass material corresponding to a desired frequency, $f_o$.

4. The antenna in accordance with claim 1, wherein each vane of said plurality of vanes has a substantially rectangular shape with a semicircular cutout in the middle of said substantially rectangular shape, said semicircular cutout having a radius of approximately 0.22 H.

5. The antenna in accordance with claim 1, wherein said transmission line is a coaxial line.

6. The antenna in accordance with claim 1, wherein said plated portions of said first conical cavity and said second conical cavity comprise a bi-conical dipole antenna.

7. The antenna in accordance with claim 6, said cylindrical hub and said plurality of vanes forming a rosette pattern surrounding said bi-conical dipole antenna.

8. An antenna, comprising:

a shell of a soda-lime-silica glass material with a body as a solid cylinder with a top and a bottom, a vertical height H of said body approximately equal to 2.8 $\lambda_g$, wherein $\lambda_g$ is a wavelength in the soda-lime-silica glass material corresponding to a desired frequency, $f_o$, said body having a diameter of approximately H;

a first conical cavity in the top of said body, said first conical cavity having a sidewall length approximately 0.51 H at approximately 46° from a vertical axis of said cylindrical hub;

a second conical cavity in the bottom of said body, said second conical cavity having a sidewall length approximately 0.51 H at approximately 46° from the vertical axis of said cylindrical hub;

wherein each of said first conical cavity and said second conical cavity has a truncated apex, said truncated apex having a diameter of approximately 0.13 H and a portion of said solid body between said first conical cavity and said second conical cavity having a thickness of approximately H/18; and a plurality of vanes attached at a 45° angle to an external wall of said body, each vane of said plurality of vanes having a thickness of approximately H/6, a width of approximately 0.78 H, and a length of approximately 1.22 H; and said antenna further comprising:

conductive plating on said first conical cavity and said second conical cavity; and a transmission line attached to said conductive plating.

9. The antenna in accordance with claim 8, wherein each vane of said plurality of vanes has a substantially-rectangular shape with a semicircular cutout in the middle of the substantially-rectangular shape.

10. The antenna in accordance with claim 9, wherein the semicircular cutout has a radius of approximately 0.22 H.

11. The antenna in accordance with claim 8, wherein said transmission line is a coaxial line.

12. The antenna in accordance with claim 8, wherein said body and said plurality of vanes form a rosette pattern surrounding said antenna.

* * * * *